US007664437B2

(12) United States Patent
Kellie et al.

(10) Patent No.: US 7,664,437 B2
(45) Date of Patent: Feb. 16, 2010

(54) DEVELOPING UNIT AND DENSITY CONTROL METHOD IN ELECTROPHOTOGRAPHY

(75) Inventors: Truman F. Kellie, Lakeland, MN (US); William D. Edwards, New Richmond, WI (US)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/122,112

(22) Filed: May 16, 2008

(65) Prior Publication Data

US 2009/0016755 A1 Jan. 15, 2009

Related U.S. Application Data

(63) Continuation of application No. 10/386,859, filed on Mar. 11, 2003, now abandoned.

(60) Provisional application No. 60/368,258, filed on Mar. 28, 2002.

(51) Int. Cl.
*G03G 15/10* (2006.01)

(52) U.S. Cl. ..... 399/240; 399/237

(58) Field of Classification Search ..... 399/57, 399/237, 240, 248, 249; 430/117.1, 118.4
See application file for complete search history.

(56) References Cited

U.S. PATENT DOCUMENTS

| | | | |
|---|---|---|---|
| 4,468,112 | A | 8/1984 | Suzuki et al. |
| 4,533,234 | A | 8/1985 | Watai et al. |
| 4,639,117 | A | 1/1987 | Murai et al. |
| 5,408,070 | A | 4/1995 | Hyllberg |
| 5,666,615 | A | 9/1997 | Nguyen |
| 5,724,629 | A | 3/1998 | Lino et al. |
| 5,812,903 | A | 9/1998 | Yamada et al. |
| 5,826,148 | A | 10/1998 | Lino et al. |
| 5,933,685 | A | 8/1999 | Yoo |

(Continued)

FOREIGN PATENT DOCUMENTS

| | | |
|---|---|---|
| JP | 63-074083 | 4/1988 |

(Continued)

OTHER PUBLICATIONS

Chinese Office Action issued in Chinese Application No. 031491677, mailed Nov. 18, 2005.

(Continued)

*Primary Examiner*—Sophia S Chen
(74) *Attorney, Agent, or Firm*—DLA Piper LLP US

(57) ABSTRACT

This invention relates to a developing unit for maintaining constant density in an electrophotographic imaging process. The developing unit has a developer roll, wherein the developer roll provides a surface and a first voltage is applied to the developer roll; a skive device, wherein the skive device is positioned in contact with the developer roll and a second voltage is applied to the skive device; a cleaning device for the developer roll, wherein the cleaning device is in contact with the developer roll; and an ink container, wherein the developer roll and the cleaning device are inside the ink container. It is preferred that a current measuring device is present to measure current flow between skive device and the developer, or a voltage meter is present to measure a voltage across a known resistor that is in series with the power supply to the skive device.

15 Claims, 2 Drawing Sheets

U.S. PATENT DOCUMENTS

| | | | | |
|---|---|---|---|---|
| 5,937,229 | A | 8/1999 | Walgrove et al. | |
| 6,115,561 | A | 9/2000 | Fukushima | |
| 6,118,966 | A * | 9/2000 | Deishi et al. | 399/237 |
| 6,278,849 | B1 | 8/2001 | Kawasaki | |
| 6,415,124 | B1 | 7/2002 | Nishikawa | |
| 6,687,477 | B2 | 2/2004 | Ichida et al. | |
| 2002/0159794 | A1 * | 10/2002 | Nakashima et al. | 399/237 |

FOREIGN PATENT DOCUMENTS

| | | |
|---|---|---|
| JP | 08-015993 | 1/1996 |
| JP | 09-211993 | 8/1997 |
| JP | 10-301398 | 11/1998 |
| JP | 2001-194912 | 7/2001 |
| JP | 2001-324876 | 11/2001 |
| JP | 2002-333778 | 11/2002 |

OTHER PUBLICATIONS

Partial English language translation of Chinese Office Action issued in Chinese Application No. 031491677, mailed Nov. 18, 2005.
English language abstract of JP 63-074083, published Apr. 4, 1988.
English language abstract of JP 2002-333778, published Nov. 22, 2002.
English language abstract of JP 09-211993, published Aug. 15, 1997.
English language abstract of JP 08-15993, published Jan. 19, 1996.
English language abstract of JP 10-301398, published Nov. 13, 1998.
English language abstract of JP 2001-324876, published Nov. 22, 2001.
English language abstract of JP 2001-194912, published Jul. 19, 2001.

* cited by examiner

DEVELOPING UNIT AND DENSITY CONTROL METHOD IN ELECTROPHOTOGRAPHY

CROSS REFERENCE TO RELATED APPLICATIONS

This application is a continuation of U.S. patent application Ser. No. 10/386,859, filed Mar. 11, 2003, which claims priority of U.S. Provisional Application No. 60/368,258, filed. Mar. 28, 2002. Which are incorporated by reference in their entireties.

BACKGROUND OF THE INVENTION

1. Field of Invention

This invention relates to a novel electrophotographic apparatus and process suitable for use in electrophotography and, more specifically, to a developing unit and a method for controlling the consistency of density in an electrophotographic process.

2. Background

It is often useful to print large quantities of multi-colored prints to paper for the purpose of disseminating multiple copies of reports or brochure information. One objective of this kind of printing is that all the reports or brochures look the same, which means that all the printing of the color and monochrome pages must maintain a consistent density as printing progresses. It is not desirable to allow the densities of primary colors to vary from page to page because the final product of the reports and/or brochures will be degraded if the colors are varying from document to document. Therefore it is important to measure and control the density of images (i.e., plated toner or ink) during the printing process to assist in maintaining constant density during the printing process.

To accomplish the printing of constant density images over time in the printing process or other electrophotographic applications, several methods have been described. One attempt disclosed in U.S. Pat. No. 5,243,391 (Williams) is a system that measures the percent solids in the ink solution as an electrical resistance and then adjusts the gap between the developing element and the ink receptor to modify the electric field in the printing nip. This kind of hardware is both costly and difficult to maintain in the liquid ink environment.

Another example of an image control system is in U.S. Pat. No. 5,933,685 (Yoo) which uses the detection of ink solids by optical means. No provision is made for detecting ink conductivity. However, constant density printing can occur with this arrangement only if the ink conductivity remains constant in the presence of decreasing ink solids and ink conductivity is not considered by this process. A similar method also uses ink concentration sensing for print density control but also fails to account for ink conductivity variations that may affect print density.

Many attempts (for example, U.S. Pat. No. 4,468,112 to Suzuki) are found that try to overcome the above defined problem of image density variation other than by sensing the toner concentration control in the developing unit. These methods of print density control need a test patch (i.e., reference image on a patch) to be prepared separately from an output image, the density of the reference image which has been developed is then measured, and the toner is supplied such that its density assumes a prescribed value. In this method, since in many cases an-electrostatic image of the reference patch is always developed under constant potential contrast, the fact that the density of the patch assumes a prescribed value means that the ink concentration is variably controlled so that the toner charge amount is maintained at a constant level. These attempts also further require a density measuring system to measure the density of the test patch. All such similar methods require recording, developing and measuring steps that may add cost and complexity to the printing hardware. Another similar approach (e.g., U.S. Pat. No. 6,115,561 to Fukushima) uses a special pattern in the imaging system along with a lookup table, but the density measurement of the special pattern is still required or else the measurement needs more than just one special pattern. Clearly, the previous methods for print density control with respect to time all need special hardware in addition to the printing hardware, and many also need the involvement of the ink receptor where test patches must be printed and analyzed.

One method as disclosed in, for example, Japanese unexamined Patent Publication Nos. 108070/1989, 314268/1989, 8873/1990, 110476/1990, 75675/1991, and 284776/1991, is the use of a pixel counting method wherein the image density of an output image or the number of pixels that are written is counted, and the amount of toner consumption is estimated in a corresponding manner so as to supply the toner. This is a method in which the amount of toner that to be consumed for forming a dot is assumed. With this method, there has been the problem that even if the toner supply error may be very small in each print, the errors accumulate over a long term, leading to a large toner concentration error in the final run.

SUMMARY OF THE INVENTION

The present invention relates to the control of print density in the output from a printing machine by utilizing a developing unit that has been equipped with current measuring means. Specifically, at least one color of ink may be printed to a desired density by this developing unit and the print density of that color will be held constant throughout the useful life of the ink cartridge. The level of ink in this developing unit should or must be held to within specified limits of a set point level by the addition of pure carrier solvent as printing progresses. Use of one, two, three or four such units each of which prints one primary color may be utilized to produce full color images with all colors printed at their target densities for the useful lives of their respective ink cartridges.

In a first aspect, the invention features a developing unit that includes: (a) a developer roll (that is an element onto which a charge is placed and imagewise dissipated and onto which ink is applied to form a transferable image of final image), wherein the developer roll comprises a surface and a first voltage is applied to the developer roll; (b) a skive device, wherein the skive device is positioned in contact with the developer roll and a second voltage is applied to the skive device; (c) a cleaning device for the developer roll, wherein the cleaning device is in contact with the developer roll; and (d) an ink container, wherein the developer roll and the cleaning device are inside the ink container.

In a second aspect, the invention features a method for maintaining constant density in an imaging process such as electrography, electrophotography or printing that includes: (a) providing a developing unit comprising a developer roll, a skive device, a cleaning device, and an ink container, wherein the developer roll and the cleaning device are inside the ink container; (b) providing an ink in the ink container; (c) applying a first voltage to the developer roll; (d) moving said developer roll; (e) applying a second voltage to the skive device; and (f) controlling a plating current between the developer roll and the skive device to obtain a constant thickness of ink plated on a surface of the developer roll by adjusting the first voltage, the second voltage, or a combination of thereof.

BRIEF DESCRIPTION OF THE DRAWINGS

These and other objects, advantages and features of the present invention will be more readily understood from the following detailed description of certain preferred embodiments thereof, when considered in conjunction with the accompanying drawings in which.

DETAILED DESCRIPTION OF THE INVENTION

Figure 1:
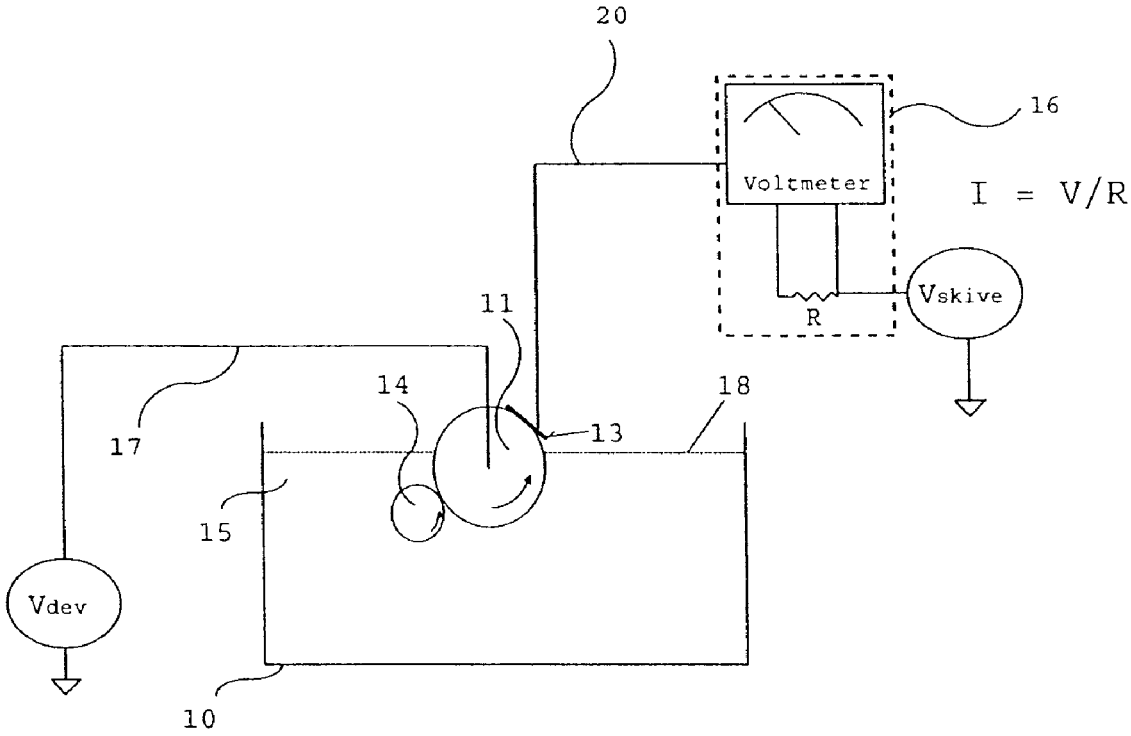
FIG. 1 is a schematic diagram of a developing unit, equipped with a skive blade in an ink container filled with liquid toner to a prescribed level.

Generally, an ink receptor (e.g., photosensitive medium) such as a photosensitive belt or photosensitive drum is used in an electrophotographic printer. The surface of the photosensitive medium can be charged to a required electrical potential and the level of the electric potential can be selectively changed by imagewise radiation exposure, as by a scanned beam, thereby forming an electrostatic latent image. The printers are conceptually divided into a dry type and a liquid type according to the state of inks that are provided and attached to the electrostatic latent image. In a liquid type printer (e.g., liquid electrophotography), a developing unit obtained by mixing ink particles and a liquid carrier is used in printing. The carrier liquid may be selected from a wide variety of materials which are well known in the art. The carrier liquid is typically oleophilic, chemically stable under a variety of conditions, and electrically insulating. Electrically insulating means that the carrier liquid has a low dielectric constant and a high electrical resistivity. Preferably, the carrier liquid has a dielectric constant of less than 5, and still more preferably less than 3. Examples of suitable carrier liquids are aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like), silicone oils and blends of these solvents. Preferred carrier liquids include paraffinic solvent blends sold under the names Isopar® G liquid, Isopar® H liquid, Isopar® K liquid and Isopar® L liquid (manufactured by Exxon Chemical Corporation, Houston, Tex.). The preferred carrier liquid is Norpar® 12 or Norpar® 15 liquid, also available from Exxon Corporation. The ink particles are comprised of colorant embedded in a thermoplastic resin. The colorant may be a dye or more preferably a pigment. The resin may be comprised of one or more polymers or copolymers which are characterized as being generally insoluble or only slightly soluble in the carrier liquid; these polymers or copolymers comprise a resin core.

One format of an electrophotographic system functions by providing an ink supply having both a developer roll and a conductive skive device forming an electrical bias between the developer roll and the conductive skive device through the conductivity of the ink. The conductive skive device establishes a differential voltage across the ink to the developer roll, and when the differential is sufficiently large, charged particles in the ink deposit either on the developer roll or on the conductive skive device. To make this system function, at least three conditions must be met. (The third condition being that the ink must be charged in such a manner that the ink particles migrate (plate) to the developer roll rather than to the conductive skive device.) The voltage differential (the bias charge) must be sufficiently large so as to cause concentrated liquid comprising the charged particles in their carrier to deposit strongly (referred to in the electrophotographic art as plating) onto the surface of the developer roll, and there must be sufficient concentration of particles in the ink so that the applied voltage differential (at the speed of rotation of the developer roll) will be able to plate a sufficient amount of ink onto the developer roll. During use of this electrophotographic system, certain phenomena occur that alter the quality of performance of the system. As particles in the ink are used to plate the developer roll and assist in the printing of images, the ambient concentration of particles in the ink decreases. This decrease in the concentration of conductive particles increases the electrical resistance (reduces the conductivity) of the ink between the conductive skive device and the developer roll. As a standard constant voltage differential is maintained across the developer roll and the conductive skive device, less and less concentration of ink will be plated on the developer roll as the particles are depleted. This leads to a reduction in image density on a point-by-point basis in the image, as less ink is available for transfer to an electrophotographic latent image on a photoconductor. Inconsistency in image density reproduction is therefore increased.

The plating of the ink is accomplished by the formation of a relatively concentrated and thin (a few microns, e.g., 1-20 microns) layer of carrier liquid and electrophotographic particles. Typical particle concentrations in these plated layers are between 15 and 30% by volume of particles. For purposes of this discussion, it will be assumed that a preferred range of 20-25% by volume particles/ink will be present, and specifically 22% by volume particles to ink will be present in the plated layer. As the concentration of particles in the ambient ink in the system decreases over use, the concentration of the ink is usually below and at times well below this 22% target for plating. It is therefore important that proper controls be exercised on the system to assure that sufficient amounts of plated ink at the required concentration be plated on the surface of the developer roll.

The underlying principle in the practice of the invention is that the work (electrical work) needed to plate an appropriate layer onto the developer roll remains relatively constant, but as conditions under which the electrical work is performed change (e.g., the conductivity of the ink decreases and its resistivity increases), changes must be made in other parameters of the system to keep the plating consistent. As the electrical properties of the developer roll, the conductive skive device, and the initial ink composition are known, and as the initial voltage applied between the developer roll and the conductive skive device are known, standard relationships can be determined among changing parameters such as current flow between the developer roll and the conductive skive device, resistivity of the ink, particle concentration in the ink, and voltage changes that will be needed to maintain a constant quality of plating.

An electronic look-up table or a mathematical equation based on empirical data is created which relates some of these parameters for subsequent use in the system. This table can be created once and then programmed into the processor or stored in memory for use in electrophotographic systems.

One way of doing this is as follows. A standard ink is used to determine the inter-relationship of these parameters. This should be done on a color-by-color basis, as the different color inks will vary somewhat in properties, although an average or standard value could be used where the properties of the four colors or some number of colors has been determined to be sufficiently similar to enable use of a single table. The ink is used in a system with standard developer roll and conductive skive device. Images of known percentage of coverage are made on the system and various data selected from the following are taken: 1) the concentration of the particles in the ink, 2) resistivity of the ink; 3) image density; voltage differential between the developer roll and the conductive skive device; current flow between the conductive skive device and the developer roll; and changes in the voltage or current that must be made to maintain image density in a printed image based upon standard or given signals. Once this data has been developed, and the lookup table constructed, a simple system may be established for automatically correcting image density variation from this phenomenon or the system may alert a user that changes must be performed on the electrical work parameters to maintain image density.

Once the look-up table has been constructed, the following types of relationships can be established and related. A measured resistivity of the ink indicates a specific concentration of particles in the ink. This is a measure of an approximate available life of the ink in the system and can be related to the approximate number of images or imaging time available with that particular ink. The resistance of the ink can be measured in real time on the basis of an electrical relationship. For example, because the differential voltage, $V_D$, is known between the developer roll and the conductive skive device and the current, I, can be measured, the resistance of the ink, $R_i$, can be obtained by the following equation where $R_{dev}$, the resistance of the developer roll, and $R_{dep}$, the resistance of the conductive skive device, are known and constant:

$$V_D/I=R_{dev}+R_{dep}+R_i$$

By measuring changes or the state of any two of these electrical properties in the electrophotographic system, the value of the third can be determined and the concentration of the particles in the ink can likewise be determined with a level of accuracy sufficient to warrant adjustment of the system to compensate for changes in that concentration. It should be remembered that the voltage differential is not only measurable at any time, it is actively controlled by the system. Therefore by measuring the voltage on the developer roll and the voltage on the conductive skive device, the differential is known. Plating intensity, that is, the electrical force/work driving the plating is controlled by changing this differential, usually by changing the voltage on the conductive skive device. Current can be measured by placing an ammeter in the system between a power supply and the conductive skive device, for example. The lookup table also has established a relationship between the particle concentration in the ink and the work that must be done to plate the desired layer of ink onto the developer roll. As the electrical resistance of the ink identifies the ambient concentration of particles in the ink supply, the electrical work is known which must be used in the system to plate the required ink transfer layer on the developer roll. Therefore the lookup table identifies that when a particular resistance is measured or calculated for the ambient ink supply, the voltage in the system must be at a particular level to assure proper plating from the ambient ink supply at the known concentration. Either the system can then be directed by the processor (computer) to automatically adjust the electrical work parameters (the applied voltage on the conductive skive device) or signal an operator to make the adjustment.

Any liquid ink known in the art may be used for the present invention. The liquid inks may be black or may be of different colors for the purpose of plating solid colored material onto a surface in a well-controlled and image-wise manner to create the desired prints. In some cases, liquid inks used in electrophotography are substantially transparent or translucent to radiation emitted at the wavelength of the latent image generation device so that multiple image planes can be laid over one another to produce a multi-colored image constructed of a plurality of image planes with each image plane being constructed with a liquid ink of a particular color. This property is called transmissibility for the wavelength of imaging. Typically, a colored image is constructed of four image planes. The first three planes are constructed with a liquid ink in each of the three subtractive primary printing colors, yellow, cyan and magenta. The fourth image plane uses liquid black ink, which need not be transparent to radiation emitted at the wavelength of the latent image generation device.

Figure 2:
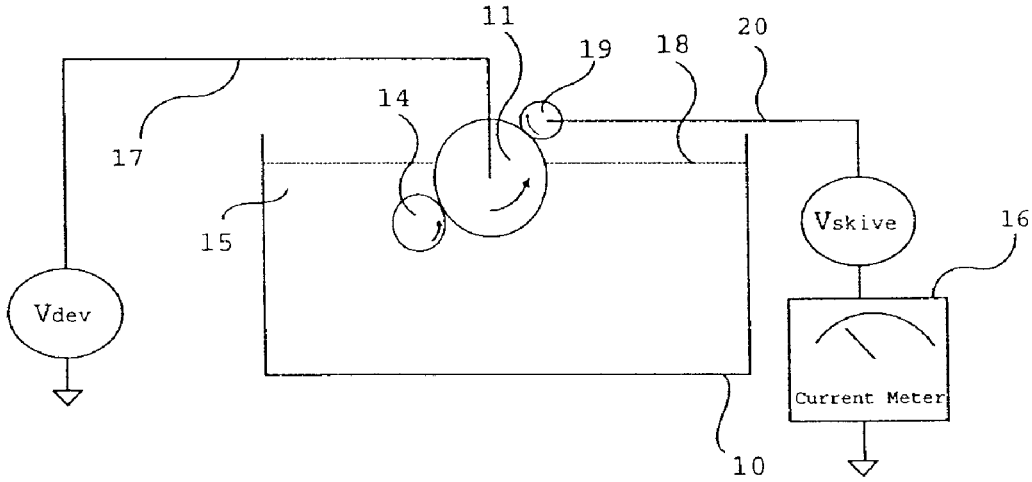
FIG. 2 is a schematic diagram of a developing unit, equipped with a skive roll, filled with liquid toner to a prescribed level.

Referring now to FIG. 1 and FIG. 2, a developing unit comprises an ink container 10 to be filled with a liquid ink 15 having an ambient particle concentration and an ambient electrical resistance to a prescribed level 18. The term "ambient" refers to the state of the material or environment at any particular time without imposition of outside influence. Ambient resistance is therefore the resistance measured at any particular time (which ambient resistivity or ambient resistance is dependent upon the concentration of conductive particles in the ambient ink composition.) That concentration changes as the ink composition has been used in imaging operations. Liquid ink 15 consists of the carrier liquid and a positively (or negatively) charged "solid" (hereinafter, a positively charged ink or a negatively charged ink), but not necessarily opaque, toner particles of the desired color for this portion of the image being printed. The charge neutrality of liquid ink 15 is maintained by negatively (or positively) charged counter ions which balance the positively (or negatively) charged pigment particles.

In general, there may be two possible methods of forming visible images on an ink receptor, i.e., moving plated ink layer or particles from developer roll 11 to an ink receptor (not shown). One method is to use an electrophoretic plating process, i.e., a gapped development, wherein ink particles are suspended in fluid (e.g., carrier liquid) and caused to migrate and plate to the ink receptor across a gap between the surface of developer roll 11 and the surface of ink receptor, wherein the gap is filled with carrier material, e.g., carrier liquid, to promote mobility of the ink particles. In this arrangement, the development process is accomplished by using a uniform electric field produced by the voltage bias of developer roll 11 which is positioned within a few thousandths of an inch from the surface of the ink receptor. In the gapped development process, developer roll 11 should be a conductive material such as metal, conductive polymer, conductive particle filled polymer, conductive particle filled composites or conductive composites. Overall volume resistivity is a volume resistivity measured after a component, e.g., developer roll 11 is finally constructed, e.g., with no over-coat, single layer over-coat, multi-layer over-coated, composite materials used and the like. Developer roll 11 is constructed with the overall volume resistivity less then or equal to about 10 Ω-cm, to avoid introducing unnecessary voltage drops in the developing circuit. The other method is a contact transfer process, i.e., the ink layer is transferred to the ink receptor, wherein the surface of developer roll 11 is in a mechanical contact with the surface of ink receptor. In this process, the transfer process is accomplished in the developer roll nip created by the surface of developer roll 11 and the surface of the ink receptor, and thus the layer of plated ink that lies on the surface of the developer roll 11 is either accepted by the discharged area of the ink receptor or is rejected by the charged area of the ink receptor. In one embodiment of the present invention, for developer roll 11 in the contact transfer process, a voltage-biased roll, which is rotating, is used and may be in contact with the ink receptor. Developer roll 11 is constructed from a less conductive material (than that of the gapped development, e.g., the overall volume resistivity of developer roll constructed, being at least $10^5$ Ω-cm) and should also have some degree of mechanical compliance so as not to push the ink from off the surface of the ink receptor. One example of such roll construction is a metal core of 0.63 cm (0.250 inches) diameter coated with a relatively soft (less then or equal to about 60 durometer Shore Hardness A, such as approximately 30 durometer Shore A hardness) and relatively conductive rubber (approximately $10^2$ Ω-cm-$10^4$ Ω-cm, such as $10^3$ Ω-cm of volume resistivity) to a diameter of 2.18 cm (0.860 inches). The conductive rubber is next coated with a thin (e.g., less than 40 micrometers, such as approximately 20 μm) coating of a relatively resistive rubber-like layer (e.g., $10^{31}$ Ω-cm-$10^{13}$ Ω-cm, such as approximately $10^{12}$ Ω-cm of volume resistivity) so that the overall volume resistivity of the roll is approximately $10^8$ Ω-cm (such as $10^7$ Ω-cm to $10^9$ Ω-cm). Another example of such a roll construction is a metal core of 1.27 cm (0.50 inches) in diameter coated with a relatively soft (approximately 30 durometer Shore A hardness) and relatively conductive rubber-like layer (e.g., $10^7$ Ω-cm to $10^9$ Ω-cm, such as approximately $10^8$ Ω-cm of volume resistivity) to a final diameter of 0.860 inches (2.18 cm) and the overall volume resistivity of the roll is approximately $10^8$ Ω-cm (such as $10^7$ Ω-cm to $10^9$ Ω-cm). In experiments, it is shown that the surface velocity of the roll may be in the range of 0.254 cm/sec (0.1 inches per second) to 25.4 cm/sec (10 inches per second) for optimal printing.

Figure 3:
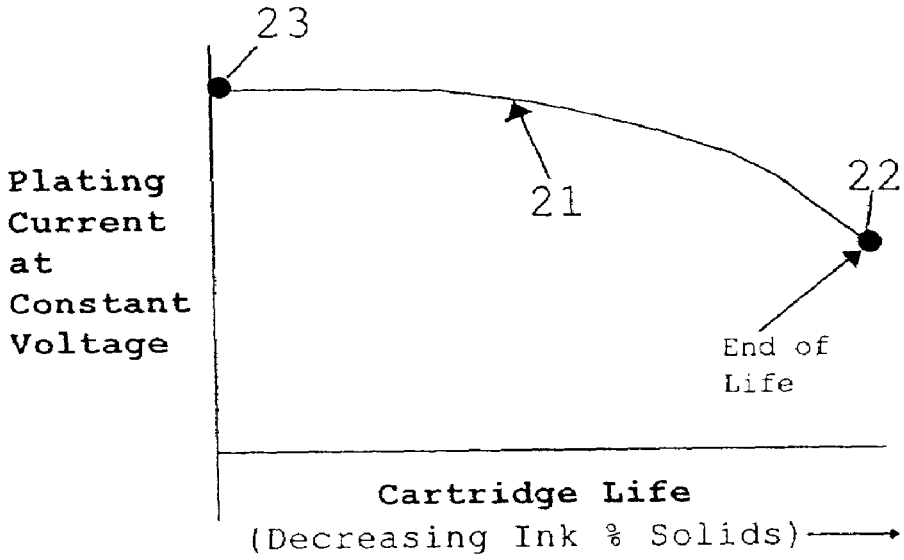
FIG. 3 depicts a plating current at constant voltage plotted against cartridge life.
Figure 4:
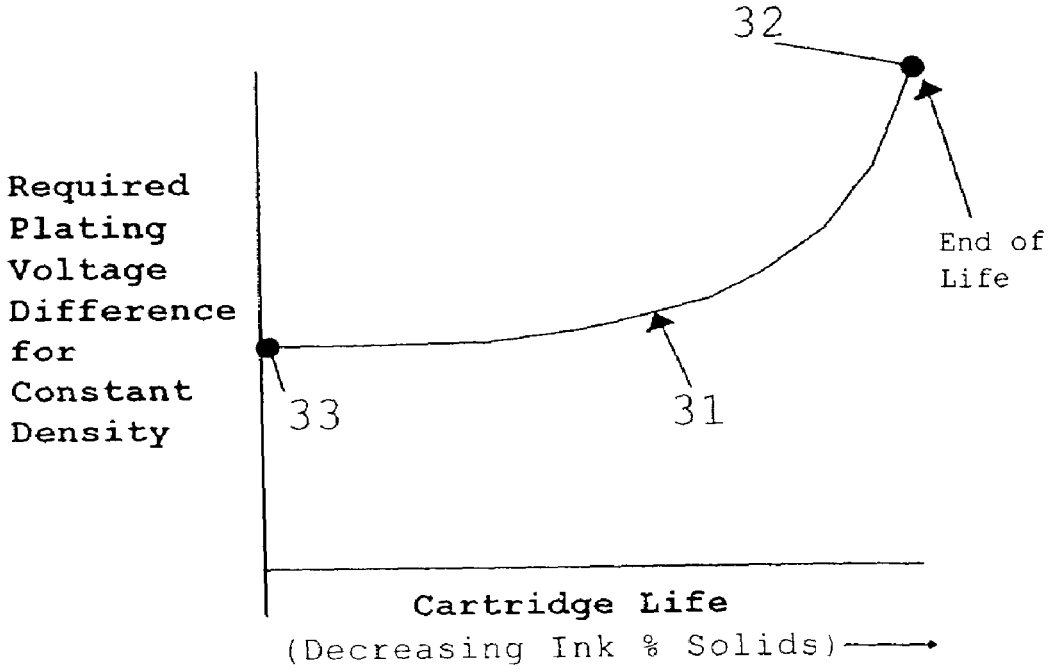
FIG. 4 depict a required plating voltage difference for constant density against cartridge life.

FIGS. 3 and 4 show graphs of a) the relationship of ink plating current versus ink particle concentration and b) applied bias voltage versus ink particle concentration at constant plating density.

A skive device (13 in FIGS. 1 and 19 in FIG. 2) is installed in a mechanical contact with developer roll 11 and not immersed in the ink of ink container 10. Skive device 13 (and 19) may be constructed with a conductive material such as metal, conductive polymer, conductive particle filled polymer, conductive particle filled composites or conductive composites, and have the overall volume resistivity at most $10^3$ Ω-cm. Both developer roll 11 and skive device may be biased with voltages, that is, a first voltage is applied to the developer roll 11 and a second voltage is applied to the skive device from a power supply and, in this way, voltages of different values may be applied to the developer roll and the skive device, respectively. In the embodiment of present invention, connecting line 17 connects developer roll 11 to a power source and connecting line 20 connects skive device to a current meter 16 such that the current flowing between developer roll and skive device may be measured at all times during use. In FIG. 1, the area inside the dashed line shows the current measuring means 16 as a voltmeter and resistor in combination. Skive device biased with the applied voltage also may prevent it from scraping plated toner off of developer roll 11 as it skives carrier liquid from the surface of the plated ink. In order to optimally function in the role of skive device, the second voltage applied to the skive device 13 (and 19) should be equal to or greater than the first voltage applied in the developer roll 11, for a positively charged ink. The conductivity value of the material may depend on the required density. In the embodiment of the present invention, 650V is applied to skive device, while 450V is applied to developer roll. Skive device can be shaped such as a skive blade (13 in FIG. 1), a skive roll (19 in FIG. 2) and the like. Skive roll 19 in FIG. 2, may be rotated by friction due to rotation of the developer roll 11, or may remain stationary. Otherwise, skive roll 19 may be installed to rotate voluntarily by providing a separate drive mechanism. In one embodiment of the present invention, for an example purpose as shown in FIG. 2, skive roll 19 rotates clockwise direction and the developer roll 11 rotates counterclockwise direction. In the contact development transfer process, the movement of the plated ink from developer roll 11 to the ink receptor is a transfer process and not a development process so that the final print density is a function of the ink mass per unit area that was plated onto developer roll 11 by skive device 13 (or 19). Biasing voltages for skive devices 13 and 19 in FIGS. 1 and 2, respectively, are shown by the element labeled "Vskive." Printing to paper with constant optical density may be accomplished by printing with constant mass per unit area on developer roll 11. An ink container 10 is also shown.

In order to clean the ink from the surface of developer roll 11, cleaning device 14 may be installed at one side of developer roll 11. There are numerous possible ways of providing a cleaning element, as long as cleaning device 14 does not wear the surface of developer roll 11. An example includes, but is not limited to a doctoring blade, squeegee, sponge, pad or the like scraping off the ink from the surface of developer roll 11. In one embodiment of the present invention, a soft form roll is adopted as cleaning device 14. As shown in FIG. 2, cleaning device 14 may be installed to contact developer roll 11, by which cleaning device 14 can be rotated by providing a separate drive mechanism such as a gear to allow cleaning device 14 to rotate voluntarily. One other way is that the cleaning device may be rotated by friction due to rotation of developer roll 11, which might not result in acceptable cleaning. In FIG. 1 of the embodiment of the present invention, developer roll 11 rotates in the direction shown and cleaning device 14 rotates in a direction opposite to developer roll 11. Ink container 10, in which developer roll 11 and cleaning device 14 are immersed in liquid ink 15, contains skive device 13 or 19, which may be either inside ink container or outside ink container. However, they may not be immersed in the ink.

In general, a new ink cartridge will comprise highly concentrated ink (a high percent solids of pigmented ink particles dispersed in a carrier liquid, as understood in the art) arranged to be at some ink level in the developing unit. As prints are made, both pigmented ink particles and carrier liquid will be carried out of the developing unit and thus, the ink level will be decreased. When the ink level begins to decrease, pure carrier solvent is added to the developing unit in order to maintain the desired ink level, which is approximately the same as the original ink level when the cartridge was new. Level sensors and liquid replenishment systems are quite simple and well known in the art of electrophotography; therefore, the details of the liquid level replenishment system are not offered in the present invention. In the embodiment of the present invention, an ink delivery device or a level replenishment system (not shown) may be installed so that the desired level is maintained. In general, the desired level of ink is maintained such that fresh ink particles are continuously delivered to the vicinity of the contact area (which defines the plating nip) between developer roll 11 and skive device 13 (or 19). This is done such that the plating nip is not starved for available ink particles to be plated on the surface of developer roll 11. The movement of developer roll 11, e.g., the rotation of the roll, is the only way to bring the ink to the plating nip, for the desired level of ink maintained, in this invention. Therefore, the desired level of ink in ink container 10 is maintained for at least enough liquid to cover more than bottom half of developer roll 11, but depends on design parameters such as ink container shape, the dimension of roll, and process parameters such as the speed of the roll. During the printing process, given that fresh ink particles are continuously delivered to the plating nip, the mass per unit area of plated ink particles on the surface of developer roll 11 will be largely determined by the difference of the first and second applied voltages of developer roll 11 and skive device 13 (or 19), respectively. If the voltage difference is made larger, the plated mass per unit area of ink particles on the surface of developer roll 11 may be made greater. Under these conditions and with an adjustment of the force assigned to skive device 13 (or 19) against developer roll 11, skive device may, at once, plate ink onto the surface of developer roll 11 and remove excess carrier liquid without removing plated ink particles and the percent solids of the plated ink layer may be increased prior to contacting the surface of ink receptor with the surface of developer roll 11. The optimum force uniformly assigned to skive device 13 (or 19) is a function of the compliance of developer roll 11. This force can be readily determined by trial and error.

A control scheme to maintain the constant density during a lifetime of the ink cartridge by controlling the plating current is described as below. FIG. 3 explains a relation of the plating current generated by developer roll 11 and skive device 13 (or 19), and the ink cartridge life during printing. The first voltage applied to developer roll 11 and the second voltage to skive device 13 (or 19) cause an initial plating current 23 between developer roll 11 and skive device 13 (or 19). For the positively charged ink, the second voltage applied to skive device 13 (or 19) that is greater than the first voltage applied to developer roll 11 will cause ink to be deposited on the surface of developer roll 11 in the plating nip. (This will be the case when the first voltage applied to developer roll 11 is greater than the second voltage applied to skive device 13 (or 19), for negatively charged ink). As the cartridge ages, i.e., printing proceeds, the applied voltages remains constant but the trend of the current 21 may not remain constant. In an embodiment of the present invention, the lowest value 22 is shown to represent the current at the end of life of the cartridge, i.e., no more fresh ink particles are supplied to the plating nip. This plating trend curve as a function of cartridge life for constant applied voltages is stored in a lookup table (LUT1) for use by the printing computer. FIG. 4 shows a graph of the voltage difference between the developer roll and the skive device necessary to achieve constant mass per unit area (M/A) on the developer roll over the life of the ink cartridge. The initial value 33 is when the first voltage is applied to developer roll 11 and the second voltage is applied to skive device 13 (or 19), and is mapped with the initial current 23 in FIG. 3. The initial value 33 may represent an initial percent solids of the ink in the new cartridge, as well. As printing proceeds, i.e., the cartridge ages, the current necessary to plate constant mass per unit area (M/A) becomes greater than the initial current until the end of life of the cartridge. During the printing, the ink solids will decrease, the ink conductivity may change and the ink mobility may change but these effects are all considered by recording the current required to plate a specified mass per unit area on developer roll 11 at all points in the life of the cartridge. The end of the cartridge life is defined as the point where the voltage difference between the developer roll bias and the skive device bias is greater than a specified maximum difference in order to produce the required plating current for the desired mass per unit area on the developer roll. A voltage difference curve 31 assumes a final value 32 signifying at the end of life for that cartridge, i.e., the last print in the cartridge life. The ink percent solids may be measured at this end-of-life point. The voltage difference curve as a function of cartridge life for constant M/A may be scaled between initial percent solids and final percent solids, and is stored in a lookup table (LUT2) for use by the printing computer.

By using the first LUT source (LUT1), the printing machine can know how old its ink cartridge might be at any time and therefore know what bias voltages to apply to developer roll 11 and skive device 13 (or 19) for the specified mass per unit area by accessing the second LUT (LUT2). This kind of simple current monitoring during operation can occur at any time but specifically can occur even when developer roll 11 is not in contact with the ink receptor such as when the developing unit is disengaged. The use of the ink receptor is not needed to discover the correct voltage settings for printing to a specified print density. Similarly, no external density measurement system is needed to measure the density of test patches because no plated test patches are needed with this method. Furthermore, no sensing of the ink percent solids or conductivity or mobility is necessary for the printing of constant density throughout the life of the ink cartridge. Because inks can be manufactured to be quite similar in property from batch to batch, the printing machine LUT information may be programmed into the printer at the point of manufacture and should not need modification throughout the life of the printer itself.

The requirement that ink density should remain constant and invariant has been troublesome when the ink varies in its concentration and its conductivity within the ink container during printing process. The requirement of constant and invariant density is met by the apparatus and method in accordance with the present invention.

Other enabled embodiments are described within the following claims.

What is claimed is:

1. A developing unit for developing an image using liquid developer that includes a mixture of toner particles and liquid carrier, comprising:

a liquid developer container configured to contain an amount of liquid developer;

a developer roller disposed at a location relative to the liquid developer container such that at least a portion of the developer roller is immersed in the liquid developer contained in the liquid developer container, the developer roller comprising a surface, on which to support a quantity of liquid developer, the developer roller being applied a first voltage;

a skive device disposed to be in contact with the surface of the developer roller so as to remove excess liquid carrier from the surface of the developer roller, a second voltage being applied to the skive device, the skive device not being immersed in the liquid developer contained in the liquid developer container;

a current measuring device configured to measure current flow between the skive device and the developer roller; and at least one voltage source configured to produce said first voltage and said second voltage, the at least one voltage source being configured to vary at least one of the first voltage and the second voltage according to the measured current flow between the skive device and the developer roller.

wherein the second voltage is sufficiently different from the first voltage to cause the toner particles of the liquid developer on the surface of the developer roller migrate toward the surface of the developer roller.

2. The developing unit according to claim 1, wherein the skive device comprises overall volume resistivity of at most $10^3$ Ω-cm.

3. The developing unit according to claim 1, wherein said skive device comprises a roller.

4. The developing unit according to claim 1, wherein said skive device comprises a blade.

5. The developing unit according to claim 1, further comprising:

a cleaning device is in contact with the developer roller; the cleaning device being immersed in the liquid developer contained in the liquid developer container.

6. An image forming apparatus for forming a visual image using liquid developer that includes a mixture of toner particles and liquid carrier, comprising:

a liquid developer container configured to contain an amount of liquid developer;

a developer roller disposed at a location relative to the liquid developer container such that at least a portion of the developer roller is immersed in the liquid developer contained in the liquid developer container, the developer roller comprising a surface, on which to support a quantity of liquid developer;

a skive device disposed to be in contact with the surface of the developer roller so as to remove excess liquid carrier from the surface of the developer roller, the skive device not being immersed in the liquid developer contained in the liquid developer container; and at least one voltage source configured to produce a first voltage and a second voltage, the first voltage being applied to the developer roller, the second voltage being applied to the skive device, the second voltage being sufficiently different from the first voltage to cause the toner particles of the liquid developer on the surface of the developer roller migrate toward the surface of the developer roller;

a current measuring device configured to measure current flow between the skive device and the developer roller; and a printing computer configured to control the at least one voltage source to vary at least one of the first and second voltages based on the current flow measured by the current measuring device.

7. The image forming apparatus according to claim 6, further comprising:

a look-up table that defines the relationship between the current flow measured by the current measuring device and a desired voltage difference between the first and the second voltages, wherein die printing computer uses the look-up table to control the at least one voltage source.

8. The image forming apparatus according to claim 6, wherein the skive device comprises one of a roller and a blade, and has an overall volume resistivity of at most $10^3$ Ω-cm.

9. The image forming apparatus according to claim 6, further comprising:

a cleaning device is in contact with the developer roller; the cleaning device being immersed in the liquid developer contained in the liquid developer container.

10. A method for maintaining constant density in an electro-photographic imaging forming using liquid developer containing a mixture of toner particles and liquid carrier, comprising:

providing a liquid developer container, a developer roller and a skive device, the liquid developer container containing an amount of liquid developer, the developer roller comprising a surface on which to support a quantity of liquid developer, and being disposed at a location relative to the liquid developer container such that at least a portion of the developer roller is immersed in the liquid developer contained in the liquid developer container, the skive device being in contact with the surface of the developer roller, the skive device not being immersed in the liquid developer contained in the liquid developer container;

measuring a current between the skive device and the developer roller;

adjusting a difference between a first voltage and a second voltage based on the measured current between the skive device and the developer roller, the first voltage being applied to the developer roller, the second voltage being applied to the skive device, the difference between a first voltage and a second voltage causing the toner particles of the liquid developer on the surface of the developer roller migrate toward the surface of the developer roller.

11. The method for maintaining constant density as set forth in claim 10, wherein the difference between the first voltage and the second voltage is adjusted by reference to at least one lookup table.

12. The method for maintaining constant density as set forth in claim 10, wherein the step of measuring the current the skive device and the developer roller comprises:

measuring a voltage across a known resistor that is in series with a voltage source that supplies the second voltage to the skive device.

13. The method for maintaining constant density as set forth in claim 10, wherein the step of providing the skive device comprises:

providing a roller having an overall volume resistivity of at most $10^3$ Ω-cm.

14. The method for maintaining constant density as set forth in claim 10, wherein the step of providing the skive device comprises:

providing a blade having an overall volume resistivity of at most $10^3$ Ω-cm.

15. The method for maintaining constant density as set forth in claim 10, cleaning the developer roller with a cleaning device in contact with the developer roller; the cleaning device being immersed in the liquid developer contained in the liquid developer container.

* * * * *